US006972310B2

(12) United States Patent
Isogawa

(10) Patent No.: US 6,972,310 B2
(45) Date of Patent: Dec. 6, 2005

(54) GOLF BALL AND METHOD OF MAKING THE SAME

(75) Inventor: Kazuhiko Isogawa, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 74 days.

(21) Appl. No.: 10/650,989

(22) Filed: Aug. 29, 2003

(65) Prior Publication Data

US 2004/0043836 A1 Mar. 4, 2004

(30) Foreign Application Priority Data

Aug. 30, 2002 (JP) ..... 2002-253338

(51) Int. Cl.[7] ..... A63B 37/00; C09D 11/10

(52) U.S. Cl. ..... 525/528; 473/351; 473/371; 473/378; 106/31.75; 106/31.77; 101/491

(58) Field of Search ..... 525/528; 473/351, 473/371, 378; 106/31.75, 31.77; 101/491

(56) References Cited

U.S. PATENT DOCUMENTS

2002/0037777 A1 * 3/2002 Isogawa ..... 473/351
2003/0027663 A1 * 2/2003 Okido et al. ..... 473/351
2004/0043838 A1 * 3/2004 Isogawa et al. ..... 473/378

FOREIGN PATENT DOCUMENTS

EP 0 509 829 A1 10/1992
JP 5-112746 A 5/1993

* cited by examiner

*Primary Examiner*—David J. Buttner
(74) *Attorney, Agent, or Firm*—Birch, Stewart, Kolasch & Birch, LLP

(57) ABSTRACT

The present invention provides a golf ball having a marking that can be directly printed on the surface of golf ball body without undercoating treatment when printing the marking and has good appearance and excellent durability after repeated hitting. The present invention relates to a golf ball having a marking printed with an ink composition on the surface thereof, wherein the ink composition comprises epoxy resin having a terminal OH group, polyisocyanate curing agent and a coloring agent as essential components, and the curing agent comprises 25 to 35% by weight of isocyanurate polyisocyanate derived from hexamethylene diisocyanate, 25 to 35% by weight of biuret polyisocyanate derived from hexamethylene diisocyanate and 35 to 50% by weight of isocyanurate polyisocyanate derived from isophorone diisocyanate.

10 Claims, No Drawings

GOLF BALL AND METHOD OF MAKING THE SAME

This nonprovisional application claims priority under 35 U.S.C. §119 (a) on Patent Application No. 2002-253338 filed in Japan on Aug. 30, 2002, which is herein incorporated by reference.

FIELD OF THE INVENTION

The present invention relates to a golf ball. More particularly, it relates to a golf ball having a marking printed on the surface thereof with an ink composition, which can be directly printed on the surface of golf ball body.

BACKGROUND OF THE INVENTION

Golf balls are generally finished to put markings thereon, such as letters indicating trade names or numbers, numerals, designed drawings and the like. A conventional method for printing the marking on the golf ball has comprised the steps of; applying a white paint to the surface of a golf ball body as an undercoating treatment; printing a marking on the white painted surface; and then applying a clear paint over the white painted surface and the printed marking to improve the appearance and durability of the golf ball.

Recently, there has been required to simplify the applying step or reduce the number of the steps. In order to satisfy the requirements, a method for printing a marking directly on the surface of a cover comprised of ionomer resin containing a white pigment has been proposed (Japanese Patent Kokai Publication No. 112746/1993 and the like). In Japanese Patent Kokai Publication No. 112746/1993, a golf ball printing ink comprising a coloring matter, and a carrier therefor containing nitrocellulose therein as an essential ingredient is disclosed. The printing ink allows the marking to be printed directly on the surface of a cover without undercoating treatment while avoiding unintended transfer of the ink from one golf ball to another due to contact with adjacent golf balls before applying a clear paint over the ink.

However, it is required for the marking of the golf ball to have a sufficient durability to endure impact force from repeated hitting. Since the golf ball printing ink does not sufficiently have adhesion to ionomer resin cover, it has been problem that the printed marking is peeled off together with the clear paint film, when the clear paint film is peeled off due to repeated hitting with a golf club or at bunker shot.

A method for printing a marking on a golf ball body includes pad printing technique. When a printing ink does not sufficiently have adhesion to the surface of the golf ball body and transferability from a pad to the golf ball body in the pad printing, it has been problem that the appearance of the printed marking is degraded such that there is a defective pattern or pinhole due to an ink portion not transferred to the golf ball body.

OBJECTS OF THE INVENTION

A main object of the present invention is to provide a golf ball having a marking that can be directly printed on the surface of golf ball body without undercoating treatment when printing the marking and has good appearance and excellent durability after repeated hitting.

According to the present invention, the object described above has been accomplished by providing a golf ball having a marking printed with an ink composition comprising epoxy resin having a terminal OH group, polyisocyanate curing agent and a coloring agent as essential components, and using the curing agent comprising isocyanurate polyisocyanate derived from hexamethylene diisocyanate, biuret polyisocyanate derived from hexamethylene diisocyanate and isocyanurate polyisocyanate derived from isophorone diisocyanate, thereby providing a golf ball having a marking that can be directly printed on the surface of golf ball body without undercoating treatment when printing the marking and has good appearance and excellent durability after repeated hitting.

SUMMARY OF THE INVENTION

The present invention relates to a golf ball having a marking printed with an ink composition on the surface thereof, wherein the ink composition comprises epoxy resin having a terminal OH group, polyisocyanate curing agent and a coloring agent as essential components, and the curing agent comprises 25 to 35% by weight of isocyanurate polyisocyanate derived from hexamethylene diisocyanate, 25 to 35% by weight of biuret polyisocyanate derived from hexamethylene diisocyanate and 35 to 50% by weight of isocyanurate polyisocyanate derived from isophorone diisocyanate.

In the golf ball of the present invention having a marking printed with an ink composition on the surface thereof, the ink composition comprising epoxy resin having a terminal OH group, the above polyisocyanate curing agent and a coloring agent as essential components is used. Therefore, the marking can be directly printed on the surface of golf ball body comprised of ionomer cover or rubber molded article without undercoating treatment when printing the marking; the marking has good appearance such that there is no pinhole and stain by unintended transfer of the marking ink from another golf ball; and the marking has excellent durability such that the printed marking can be remained when the clear paint layer, which is the outmost layer of the golf ball, is peeled off due to repeated hitting with a golf club or at bunker shot. According to the present invention, a golf ball having the marking printed on the surface thereof, and a method of making the golf ball are provided.

In another embodiment, the present invention relates a method of making the golf ball comprising the steps of (a) producing a golf ball body, (b) pretreating the surface of the golf ball body by at least one of treatment selected from the group consisting of grinding treatment, blasting treatment and washing treatment, (c) printing a marking on the golf ball body by pad printing with an ink composition, wherein the ink composition comprises epoxy resin having a terminal OH group, polyisocyanate curing agent and a coloring agent as essential components, and the curing agent comprises 25 to 35% by weight of isocyanurate polyisocyanate derived from hexamethylene diisocyanate, 25 to 35% by weight of biuret polyisocyanate derived from hexamethylene diisocyanate and 35 to 50% by weight of isocyanurate polyisocyanate derived from isophorone diisocyanate, and (d) applying a paint on the surface of the golf ball body having the marking printed.

The term "golf ball body" as used herein refers to a golf ball itself before it is coated with paint, of which the surface portion has many depressions called "dimples". A marking is printed on the surface of the golf ball body by using an ink composition.

DETAILED DESCRIPTION OF THE INVENTION

The golf ball of the present invention may be either solid golf balls, such as a one-piece golf ball, two-piece golf ball, and multi-piece golf ball represented by a three-piece golf ball, or thread wound golf balls.

In case of the solid golf ball, one-piece golf ball or a core used for solid golf (solid core) may be the same one that has been conventionally used, and may be obtained by mixing a rubber composition using a mixer such as a mixing roll, and then vulcanizing and press-molding under applied heat the rubber composition in a mold into a spherical form. The rubber composition comprises 10 to 60 parts by weight of a vulcanizing agent (crosslinking agent), for example, α,β-unsaturated carboxylic acid (such as acrylic acid, methacrylic acid, etc.) or mono or divalent metal salts, such as zinc or magnesium salts thereof, or a functional monomer such as trimethylolpropane trimethacrylate, or a combination thereof;

0.5 to 5 parts by weight of co-crosslinking initiator such as organic peroxides;

10 to 30 parts by weight of filler such as zinc oxide, barium sulfate and the like; and optionally antioxidant, based on 100 parts by weight of a base rubber such as polybutadiene. The vulcanization may be conducted, for example, by press molding in a mold at 130 to 240° C. and 2.9 to 11.8 MPa for 15 to 60 minutes. It is preferable for the surface of the resulting core to be buffed to improve the adhesion to the cover layer formed on the core. The solid core may have single-layered structure or multi-layered structure which has two or more layers.

The core for thread wound golf ball (thread wound core), which may be also the same one that has been conventionally used, comprises a center and a thread rubber layer formed by winding thread rubber in a stretched state around the center, wherein the center may be either liquid center or solid center formed from rubber composition. The thread rubber can be of the same kind, which has been conventionally used for the thread rubber layer of the thread wound golf ball. For example, the thread rubber can be obtained by vulcanizing a rubber composition prepared by formulating sulfur, a vulcanization aid, a vulcanization accelerator, an antioxidant and the like to a natural rubber or a blend rubber of the natural rubber and a synthetic polyisoprene. A thread-wound core can be produced by drawing the thread rubber about 1000% and winding it over the center. However, such solid and thread-wound cores are given by way of illustrative examples only, and the invention shall not be limited thereto.

The cover is then covered on the core. In the golf ball of the present invention, the cover may be formed from thermoplastic resin such as ionomer resin and thermoplastic elastomer, balata or hard rubber and the like, which has been conventionally used for the cover of the golf ball.

In the golf ball of the present invention, the cover composition may optionally contain pigments (such as titanium dioxide, etc.) and the other additives such as a dispersant, an antioxidant, a UV absorber, a photostabilizer and a fluorescent agent or a fluorescent brightener, etc., in addition to the above base resin as long as the addition of the additives does not deteriorate the desired performance of the golf ball cover.

A method of covering on the core with the cover is not specifically limited, but may be a conventional method. For example, there can be used a method comprising molding the cover composition into a semi-spherical half-shell in advance, covering the core with the two half-shells, followed by press molding, or a method comprising injection molding the cover composition directly on the core, which is covered with the cover, to cover it. At the time of molding the cover, many depressions called "dimples" are formed on the surface of the golf ball.

In the golf ball of the present invention, it is desired to pretreat the surface of the golf ball body before printing a marking in order to improve the adhesion to the marking or paint. The pretreatment is performed preferably by at least one treatment selected from the group consisting of grinding or blasting treatment and washing treatment, and more preferably by the grinding or blasting treatment, followed by the washing treatment.

The grinding treatment is a method of grinding the surface of the golf ball body by using abrasive stone or abrasive cloth. Particularly preferred is barrel grinding treatment, because the productivity is excellent and it is possible to uniformly grind throughout the surface of the golf ball body, or it is always possible to uniformly grind between the golf balls. The barrel grinding treatment is a method of grinding by rotating a barrel apparatus, in which the golf ball body and abrasive stone are placed.

The blasting treatment is a method of roughening the surface of the golf ball body by blowing nonmetal particle such as silica sand or metal particle thereto at high speed. Preferred is the blasting treatment using the nonmetal particle, particularly silica sand, because it is always possible to uniformly treat throughout the surface of the golf ball body, or between the golf balls.

The washing treatment is a method of removing stain, release agent and the like on the surface of the golf ball body after molding, by which the adhesion to the paint layer is degraded, and is performed by using water, organic solvent, chemical agent and the like.

The marking is then printed on the surface of the golf ball body roughened by the pretreatment. The ink for printing a making of the golf ball of the present invention, which is the ink composition for printing a marking on the surface of the golf ball body, comprises epoxy resin having a terminal OH group, polyisocyanate curing agent and a coloring agent as essential components. The golf ball of the present invention includes the golf ball body and the marking printed on the body, and the marking is formed from the ink composition of the present invention.

The epoxy resin is contained as a base resin in the ink composition, has two or more epoxy groups in a polymer chain thereof, and is capable of crosslinking through the reaction with the curing agent. Examples of the epoxy resins used in the present invention are not limited as long as they have a terminal OH group, but include thermosetting epoxy resins such as a bisphenol A type epoxy resin obtained from bisphenol A and epichlorohydrin; a bisphenol F type epoxy resin; a novolac-type epoxy resin; a cycloaliphatic-type epoxy resin; a glycidyl ester-type epoxy resin; glycidyl amine-type epoxy resin; and the like.

In the present invention, it is desired for the epoxy resin to have a hydroxyl value of not less than 50, preferably not less than 100, more preferably not less than 150, most preferably not less than 180. The upper limit of the hydroxyl value of the epoxy resin is preferably not more than 300, more preferably not more than 250, most preferably not more than 195. The term "hydroxyl value" as used herein refers to a value serving as an indication of the amount of hydroxyl groups contained in the epoxy resin. Specifically, the hydroxyl value means the amount in "mg" of potassium hydroxide required to neutralize bonded acetyl group in acetic acid resulting from saponification of an acetylated compound. When the hydroxyl value of the epoxy resin is smaller than 50, the crosslinking between the epoxy resin and curing agent is not sufficiently conducted, and the durability of the marking is degraded. On the other hand, when the hydroxyl value is larger than 300, a large amount of the curing agent is required for curing the epoxy resin, and the reactivity is too high. Therefore, the pot life of the ink composition is short, and the workability of the ink composition is degraded.

In thermosetting epoxy resin, three-dimensional crosslinking reactions proceed through a crosslinking reaction with a curing agent. Since the crosslinking reactions rapidly proceed by heating in the presence of the curing agent, it is possible to prevent the marking ink from transferring from one golf ball to another during conveyance to the succeeding step of an application of a clear paint. In addition, since the crosslinking reactions proceed to form network structure, the durability, such as the scuff resistance of the resulting marking is excellent.

Hydroxyl groups in the epoxy resin can also contribute good affinity of the ink for the surface of the golf ball body, particularly for an ionomer resin cover, and the marking can be directly printed thereon without undercoating. In addition, since the backbone chain bond of the epoxy resin molecular is ether linkage, which has large free rotation of the molecular, the cured epoxy resin imparts the marking to pliability and flexibility. Therefore, a marking adaptable to the deformation of the golf ball at the time of hitting is obtained, and it is possible to restrain crazing or peeling of the marking due to repeated hitting.

In the ink composition for printing a marking of present invention, it is required for the curing agent to comprise (a) 25 to 35% by weight of isocyanurate polyisocyanate derived from hexamethylene diisocyanate, (b) 25 to 35% by weight of biuret polyisocyanate derived from hexamethylene diisocyanate, and (c) 35 to 50% by weight of isocyanurate polyisocyanate derived from isophorone diisocyanate, based on the total weight of the curing agent. The amount of the component (a) is preferably 26 to 34% by weight, more preferably 27 to 33% by weight; the amount of the component (b) is preferably 26 to 34% by weight, more preferably 27 to 33% by weight; and the amount of the component (c) is preferably 37 to 48% by weight, more preferably 39 to 46% by weight, based on the total weight of the curing agent.

When the amount of the component (a) is smaller than 25% by weight, the marking ink layer is brittle and the marking is easily peeled off, which degrades the durability of the marking. On the other hand, when the amount of the component (a) is larger than 35% by weight, the amount of the isocyanurate polyisocyanate derived from isophorone diisocyanate is relatively small, and the curing rate of the ink composition is small. Therefore, the ink transfer stain between the golf balls is increased.

When the amount of the component (b) is smaller than 25% by weight, the compatibility with the main material (epoxy resin) is degraded, and pinholes occur in the marking. On the other hand, when the amount of the component (b) is larger than 35% by weight, the amount of the isocyanurate polyisocyanate derived from isophorone diisocyanate is relatively small, and the curing rate of the ink composition is small. Therefore, the ink transfer stain between the golf balls is increased.

When the amount of the component (c) is smaller than 35% by weight, the curing rate of the ink composition is small, and the ink transfer stain between the golf balls is increased. On the other hand, when the amount of the component (c) is larger than 50% by weight, the rate of curing reaction with the main material is large, and the pot life of the marking ink is short, which degrades the workability of the ink composition.

The ink composition of the present invention may contain any other resin in addition to the epoxy resin as a main component as long as the resin does not deteriorate the desired characteristics of the marking. Examples of the other resins include polyester resins, acrylic resins, vinyl resins, urethane resins, phenolic resins, urea resins, melamine resins, polyamide resins and the like.

In the ink composition for printing a marking of present invention, the amount of the epoxy resin is 10 to 50% by weight, preferably 15 to 45% by weight. When the amount of the epoxy resin is smaller than 10% by weight, the adhesion between the marking and the golf ball body is degraded. On the other hand, when the amount of the epoxy resin is larger than 50% by weight, the amount of the coloring agent is relatively small, and the chromaticity of the marking is low. Therefore, it is required to increase the thickness of the marking ink layer in order to improve the chromaticity, and the adhesion to the clear paint layer formed by finishing paint is degraded.

In the ink composition of the present invention, the amount of the curing agent is 1 to 30% by weight, preferably 3 to 25% by weight. When the amount of the curing agent is smaller than 1% by weight, the curing time is long, and the productivity is degraded. On the other hand, when the amount of the curing agent is larger than 30% by weight, the curing rate is too large, and the pot life of the ink composition is short, which degrades the workability of the ink composition.

The coloring agent used for the ink composition of the present invention is not limited, but may be a well-known coloring agent, which has been conventionally used in the art. Examples of such coloring agents include: black pigments such as carbon blacks including acetylene black, lamp black and aniline black; yellow pigments such as chrome yellow, zinc yellow, cadmium yellow, yellow iron oxide, mineral fast yellow, nickel-titanium yellow, Naples yellow, naphthol yellow S, Hansa yellow G, Hansa yellow 10G, benzidine yellow G, benzidine yellow GR, quinoline yellow lake, permanent yellow NCG and tartrazine lake; orange pigments such as chrome orange, molybdenum orange, permanent orange GTR, pyrazolone orange, vulcan orange, Indanthrene Brilliant Orange RK, benzidine orange G and Indanthrene Brilliant Orange GK; red pigments such as red oxide, cadmium red, red lead oxide, mercury sulfide cadmium, permanent red 4R, lithol red, pyrazolone red, Watching red calcium salt, lake red D, brilliant carmine 6B, eosin lake, rhodamine lake B, alizarin lake and brilliant carmine 3B; violet pigments such as manganese violet, fast violet B and methyl violet lake; blue pigments such as Prussian blue, cobalt blue, alkali blue lake, Victoria blue lake, phthalocyanine blue, metal-free phthalocyanine blue, partially chlorinated phthalocyanine blue, fast sky blue and Indanthrene blue BC; green pigments such as chrome green, chrome oxide, pigment green B, malachite green lake and final yellow green G; and white pigments such as silica, zinc white, titanium oxide, antimony white, zinc sulfide baryte powder, barium carbonate, clay, talc, alumina white and the like.

The amount of the coloring agent in the ink composition may be determined depending on the color strength of the marking, but is preferably 1 to 30% by weight, more preferably 3 to 25% by weight. When the amount of the coloring agent is smaller than 1% by weight, the resulting marking has low chromaticity. On the other hand, when the amount of the coloring agent is larger than 30% by weight, the adhesion of the ink to the golf ball body is degraded.

The ink composition for printing the marking of present invention preferably contains a solvent in addition to the epoxy resin, coloring agent and curing agent, and may further contain the other additives.

It is desired for the solvent to have compatibility with the epoxy resin. Examples of the solvents include aromatic hydrocarbons such as toluene and xylene; ester solvents such as ethyl acetate and butyl acetate; ether solvents such as dimethyl ether and diethyl ether; ketone solvents such as methyl ethyl ketone; alcohol solvents such as methanol, ethanol and isopropyl alcohol; and the like. The amount of the solvent used in the ink composition for printing the marking of present invention is 20 to 70% by weight, preferably 30 to 60% by weight. When the amount of the solvent is smaller than 20% by weight, the marking ink is difficult to transfer from the pad to the golf ball surface in pad printing process, and there are pinholes in the printed marking, which degrades the appearance of the resulting marking. On the other hand, when the amount of the solvent is larger than 70% by weight, the drying time of the printed marking is long, which degrades the productivity. In addition, the marking is blurred or has a defective pattern or pinhole that occurs by relatively decreasing the amounts of the resin component and coloring agent, which reduces the appearance of the marking.

The additive includes matting agent, anti-foaming agent and the like. Examples of the matting agents include colloidal silica, low-density polyethylene, medium-density polyethylene and the like. Examples of the anti-foaming agents include methyl siloxane and the like. As the additive, the amount of the matting agent is preferably from 0.5 to 5% by weight, and the amount of the anti-foaming agent is preferably from 0.5 to 5% by weight, based on the total weight of the ink composition.

The ink composition for printing the marking of present invention allows the marking to be printed directly on the surface of the golf ball body without undercoating treatment. That is, the marking can be directly printed on the surface of a cover formed from a thermoplastic resin containing an ionomer as a main component in case of multi-piece golf ball as well as on the surface of a golf ball body made from a vulcanized rubber in case of a one-piece golf ball. The ink is particularly suitable for direct printing a marking on the surface of a cover formed from a resin containing ionomer resin. Conceivably, this is because the epoxy resin as a main component of the ink composition of the present invention has a high affinity for the ionomer resin, and the resulting mark has a high adhesion to the cover. However, the marking ink of the present invention may be applied to a conventional printing process such as to print a marking after undercoating on the golf ball body.

The method for printing the marking of the present invention will be described below. The method for printing the marking of the present invention comprises the steps of: roughening the surface of the golf ball body; and printing a marking on the roughened surface of the golf ball body by a pad printing technique with the ink composition for printing the marking of the present invention.

The golf ball body to be printed may be either a multi-piece golf ball body comprising a rubber core or a thread-wound core, and a cover formed from thermoplastic resin containing an ionomer as a main component, or a one-piece golf ball body formed from a vulcanized rubber.

The pad printing technique typically comprises the steps of: filling an ink into a recess in the shape of a marking; pressing a pad against the recess to transfer the ink forming the shape of the marking to the pad; and pressing the pad against the surface of the golf ball body to transfer the ink forming the shape of the marking to the golf ball body. The pad printing technique is suitable for printing a marking on a golf ball body because it is possible to effectively print the marking on the golf ball body having many depressions such as dimples on the surface thereof. The marking ink of the present invention has excellent transferability, and is suitable for the pad printing process by which the marking ink forming a marking is transferred to the golf ball body through the pad.

After printing, the marking printed directly on the surface of the golf ball body, that is, the marking formed from the ink of the present invention is dried and cured. The drying and curing process may be conducted by merely allowing the printed marking to stand or blowing a hot air having a temperature of 30 to 70° C. against the marking.

After drying, the whole surface of the golf ball body including the marking is preferably applied with a clear paint. It is effective to protect the marking as well as to improve the appearance of the resulting golf ball. The clear paint layer may have single-layered structure or double-layered structure with a primer coat and a top coat.

For the clear paint used in the present invention, a conventional clear paint, such as urethane resin-based paint, epoxy resin-based paint, acrylic resin-based paint and polyester resin-based paint can be used. Preferred is urethane resin-based paint. It is preferable to select the paint in consideration of the adhesion to the surface of the golf ball body. As the urethane resin-based paint, a two-component type urethane-based paint comprising a main material containing a polyol having a plurality of OH groups and a curing agent containing an isocyanate having a plurality of NCO groups is suitably used.

The weight of golf balls is limited to not more than 45.92 g in accordance with the regulations for large size golf balls, but the lower limit is not established. The golf ball of the present invention has a weight of 44.0 to 45.8 g, preferably 44.2 to 45.8 g. When the weight is smaller than 44.0 g, inertia of the golf ball on the fly is lost, and the golf ball stalls at the latter half flight period, which reduces the flight distance. On the other hand, when the weight is larger than 45.8 g, the shot feel is heavy and poor.

The golf ball of the present invention can have a diameter of 41.0 to 44.0 mm, but the diameter is preferably at least 42.67 mm in accordance with the regulations for large size golf balls, and the diameter is typically about 42.75 mm.

EXAMPLES

The following Examples and Comparative Examples further illustrate the present invention in detail but are not to be construed to limit the scope of the present invention.

Examples 1 to 5 and Comparative Examples 1 to 6

Production of Core

The rubber composition for the core having formulations shown in Table 1 was mixed, and press-molded at 160° C. for 13 minutes in a mold, which is composed of an upper mold and a lower mold having a semi-spherical cavity to obtain a spherical core having a diameter of 39.3 mm.

TABLE 1

| Core composition | Amount (parts by weight) |
|---|---|
| Polybutadiene *1 | 100 |
| Zinc oxide | 5.6 |
| Zinc acrylate | 22.0 |
| Calcium carbonate | 21.0 |
| Dicumyl peroxide | 1.85 |

*1: High-cis-polybutadiene, commercially available from JSR Co., Ltd. under the trade name of "BR-11"

Preparation of Cover Composition

The material having formulations shown in Table 2 was mixed using a kneading type twin-screw extruder to obtain pelletized cover composition. The extrusion condition was, a screw diameter of 45 mm, a screw speed of 200 rpm, and a screw L/D of 35.

The formulation material was heated at 200 to 260° C. at the die position of the extruder.

TABLE 2

| Cover composition | Amount (parts by weight) |
|---|---|
| Hi-milan 1605 *2 | 40 |
| Hi-milan 1706 *3 | 30 |
| Hi-milan 1707 *4 | 30 |
| Titanium oxide | 2 |

*2: Hi-milan 1605 (trade name), ethylene-methacrylic acid copolymer ionomer resin obtained by neutralizing with sodium ion, manufactured by Du Pont-Mitsui Polychemicals Co., Ltd.
*3: Hi-milan 1706 (trade name), ethylene-methacrylic acid copolymer ionomer resin obtained by neutralizing with zinc ion, manufactured by Du Pont-Mitsui Polychemicals Co., Ltd.
*4: Hi-milan 1707 (trade name), ethylene-methacrylic acid copolymer ionomer resin obtained by neutralizing with sodium ion, manufactured by Du Pont-Mitsui Polychemicals Co., Ltd.

Production of Golf Ball Body

The cover composition was covered on the resulting core by directly injection molding to form a cover layer and obtain a two-piece golf ball body having a diameter of 42.7 mm. The mold for molding the cover, which is composed of an upper mold and a lower mold, has a semi-spherical cavity, and the cavity has dimples, of which one part is movable and also functions as hold pin. The core was placed in the cavity of the mold, and was held by putting out the hold pin. Cover resin under applied heat to 210° C. was injected in the mold, which was closed at clamping pressure of 80 t, for 0.3 seconds, and was cooled for 30 seconds to open the mold, followed by taking out the golf ball body.

Marking Print

After sandblasting the surface of the golf ball body, the marking was formed by pad printing the ink composition. Then, clear paint was coated on the surface to obtain a golf ball. The ink composition was prepared by mixing 15 g of the polyisocyanate curing agent and 20 g of the solvent at the weight ratio shown in Tables 3 and 4, with 100 g of "PAD-EPH ink", available from NAVITAS CO. The "PAD-EPH ink" contains an epoxy resin having a terminal OH group, pigment, matting agent, anti-foaming agent and solvent. With respect to the ink composition, the pot life was measured, and with respect to the resulting marking on the surface of the golf ball, the appearance and durability were evaluated, and the results are shown in the same Tables. The test methods are as follows.

Test Methods (1) Pot life of ink composition for printing a marking

The pot life of the ink composition was determined by measuring a gelation time thereof after putting the prepared ink composition in an oven of 40° C.

(2) Appearance of marking (i) Pinhole

After the marking was printed on the whole of the golf ball body, the surface of 50 printed golf balls were checked by visual observation, and the appearance of the marking was determined by evaluating the number of golf ball having pinholes in the marking. The evaluation criteria are as follows.

Evaluation Criteria o: There is no pinhole in the marking of all golf balls.

Δ: Less than 5 out of 50 golf balls have pinholes.

x: Not less than 5 out of 50 golf balls have pinholes.

(ii) Ink transfer stain

After the marking was printed on the whole of the golf ball body, the surface of 50 printed golf balls were checked by visual observation, and the appearance of the marking was determined by evaluating the number of golf ball having transfer stains of the marking ink from the other golf balls. The evaluation criteria are as follows.

Evaluation Criteria o: There is no ink transfer stain in the marking of all golf balls.

Δ: Less than 5 out of 50 golf balls have ink transfer stains.

x: Not less than 5 out of 50 golf balls have ink transfer stains.

(3) Durability of marking

After a No. 5 iron club (I#5) was mounted to a swing robot manufactured by True Temper Co. and each golf ball was hit at a head speed of 34 m/sec 150 times repeatedly, the appearance of the golf ball was checked by visual observation, and the durability of the marking was determined by evaluating the degree of separation of the marking. The evaluation criteria are as follows.

Evaluation Criteria oo: There is no separation of the marking.

o: The separated area of the marking is not more than 5%, based on the total marking area.

Δ: The separated area of the marking is larger than 5% and not less than 20%, based on the total marking area.

x: The separated area of the marking is larger than 20%, based on the total marking area.

TABLE 3

| | (parts by weight) Example No. | | | | |
|---|---|---|---|---|---|
| | 1 | 2 | 3 | 4 | 5 |
| Curing agent component | | | | | |
| (Curing agent) | | | | | |
| Polyisocyanate A *5 | 30 | 25 | 35 | 25 | 32.5 |
| Polyisocyanate B *6 | 30 | 35 | 25 | 25 | 32.5 |
| Polyisocyanate C *7 | 40 | 40 | 40 | 50 | 35 |
| (Solvent) | | | | | |
| Ethyl acetate | 20 | 20 | 20 | 20 | 20 |
| Marking | | | | | |
| Pot life (hour) | 10 | 10 | 10 | 9 | 11 |
| Appearance (Pin hole) | ○ | ○ | ○ | ○ | ○ |
| Appearance (ink transfer stain) | ○ | ○ | ○ | ○ | ○ |
| Durability of marking | ○○ | ○ | ○○ | ○ | ○○ |

TABLE 4

| | (parts by weight) Comparative Example No. | | | | | |
|---|---|---|---|---|---|---|
| | 1 | 2 | 3 | 4 | 5 | 6 |
| Curing agent component | | | | | | |
| (Curing agent) | | | | | | |
| Polyisocyanate A *5 | 40 | 20 | 30 | 30 | 35 | 27.5 |
| Polyisocyanate B *6 | 30 | 30 | 40 | 20 | 35 | 27.5 |
| Polyisocyanate C *7 | 30 | 50 | 30 | 50 | 30 | 55 |
| (Solvent) | | | | | | |
| Ethyl acetate | 20 | 20 | 20 | 20 | 20 | 20 |
| Marking | | | | | | |
| Pot life (hour) | 11.5 | 9 | 11.5 | 9 | 11.5 | 6 |
| Appearance (Pin hole) | ○ | ○ | ○ | x | ○ | ○ |
| Appearance (ink transfer stain) | x | ○ | x | ○ | x | ○ |
| Durability of marking | ○○ | Δ | ○○ | ○○ | ○ | ○ |

*5: Polyisocyanate A: isocyanurate polyisocyanate derived from hexamethylene diisocyanate ("Desmodule N-3390", manufactured by Sumitomo-Bayer Urethane Co., Ltd.)
*6: Polyisocyanate B: biuret polyisocyanate derived from hexamethylene diisocyanate ("Sumidule N-3200", manufactured by Sumitomo-Bayer Urethane Co., Ltd.)
*7: Polyisocyanate C: isocyanurate polyisocyanate derived from isophorone diisocyanate ("Desnidyke Z-4370", manufactured by Sumitomo-Bayer Urethane Co., Ltd.)

As is apparent from the results of Tables 3 to 4, the golf balls of the present invention of Examples 1 to 5, when compared with those of Comparative Examples 1 to 6, have markings that are superior in durability after repeated hitting and appearance.

On the other hand, in the golf ball of Comparative Example 1, since the amount of the polyisocyanate A in the curing agent for the ink composition for printing the marking is large and the amount of the polyisocyanate C in the curing agent for the ink composition for printing the marking is small, the pot life of the ink composition is long, and the rate of curing reaction is small. Therefore, the ink transfer stain is increased, and the appearance of the marking is degraded. In the golf ball of Comparative Example 2, since the amount of the polyisocyanate A in the curing agent for the ink composition for printing the marking is small, the printed marking is brittle, and the appearance of the marking is degraded. In the golf ball of Comparative Example 3, since the amount of the polyisocyanate B in the curing agent for the ink composition for printing the marking is large and the amount of the polyisocyanate C in the curing agent for the ink composition for printing the marking is small, the pot life of the ink composition is long, and the rate of curing reaction is small. Therefore, the ink transfer stain is increased, and the appearance of the marking is degraded.

In the golf ball of Comparative Example 4, since the amount of the polyisocyanate B in the curing agent for the ink composition for printing the marking is small, the compatibility with the main material of the ink composition is degraded. Therefore, many pinholes occur in the marking, and the appearance of the marking is degraded. In the golf ball of Comparative Example 5, since the amount of the polyisocyanate C in the curing agent for the ink composition for printing the marking is small, the pot life of the ink composition is long, and the rate of curing reaction is small. Therefore, the ink transfer stain is increased, and the appearance of the marking is degraded. In the golf ball of Comparative Example 6, since the amount of the polyisocyanate C in the curing agent for the ink composition for printing the marking is large, and the rate of curing reaction with the main material of the ink composition is large, which reduces the pot life of the ink composition.

What is claimed is:

1. A golf ball having a marking printed with an ink composition on the surface thereof, wherein the ink composition comprises epoxy resin having a terminal OH group, polyisocyanate curing agent and a coloring agent as essential components, and the curing agent comprises 25 to 35% by weight of isocyanurate polyisocyanate derived from hexamethylene diisocyanate, 25 to 35% by weight of biuret polyisocyanate derived from hexamethylene diisocyanate and 35 to 50% by weight of isocyanurate polyisocyanate derived from isophorone diisocyanate.

2. A method of making the golf ball according to claim 1 comprising the steps of (a) producing a golf ball body, (b) pretreating the surface of the golf ball body by at least one of treatment selected from the group consisting of grinding treatment or blasting treatment, and washing treatment, (c) printing a marking on the pretreated surface of the golf ball body by pad printing with the ink composition, and (d) applying a paint on the surface of the golf ball body having the marking printed.

3. The golf ball according to claim 1, wherein the curing agent comprises 26 to 34 % by weight of isocyanurate polyisocyanate derived from hexamethylene diisocyanate, 26 to 34 % by weight of burst polyisocyana derived rrom hexamethylene diisocyanate and 37 to 48 % by weigh of isocyanurate polyisocyanate derived from isophorone diisocyanate.

4. The method of making the golf ball according to claim 2, wherein 26 to 34 % by weight of isocyanurate polyisocyanate derived from hexamethylene diisocyanate, 26 to 34 % by weight of biuret polyisocyanate derived from hexamethylene diisocyanate and 37 to 48 % by weight of isocyanurate polyisocyanate derived from isophorone diisocyanate.

5. The golf ball according to claim 1, wherein the curing agent comprises 27 to 33 % by weight of isocyanurate polyisocyanate derived from hexamethylene diisocyanate, 27 to 33 % by weight of biuret polyisocyanate derived from hexamethylene diisocyanate and 39 to 46 % by weight of isocyanurate plyisocyanate derived from isophorone diisocyanate.

6. The method of making the golf ball according to claim 2, wherein 27 to 33 % by weight of isocyanurate polyisocyanate derived from hexamethylene diisocyanate, 27 to 33 % by weight of biuret polyisocyanate derived from hexamethylene diisocyanate and 39 to 46 % by weight of isocyanurate derived from isophorone diisocyanate.

7. The golf ball according to claim 1, wherein the amount of the epoxy resin is 10 to 50 % by weight and the amount of the curing agent is 1 to 30 % by weight.

8. The method of making the golf ball according to claim 2, wherein the amount of the epoxy resin is 10 to 50 % by weight and the amount of the curing agent is 1 to 30 % by weight.

9. The golf ball according to claim 1, wherein the amount of the epoxy resin is 15 to 45 % by weight and the amount of the curing agent is 3 to 25 % by weight.

10. The method of making the golf ball according to claim 2, wherein the amount of the epoxy resin is 15 to 45 by weight and the amount of the curing agent is 3 to 25 % by weight.

* * * * *